US007720403B2

(12) United States Patent
Suzuki et al.

(10) Patent No.: US 7,720,403 B2
(45) Date of Patent: May 18, 2010

(54) INFORMATION PROCESSING EQUIPMENT, IMAGE DISPLAY PROGRAM PRODUCT, AND IMAGE FORMING SYSTEM

(75) Inventors: Masayoshi Suzuki, Osaka (JP); Eiji Mifune, Osaka (JP); Katsushi Horihata, Osaka (JP)

(73) Assignee: Kyocera Mita Corporation (JP)

( * ) Notice: Subject to any disclaimer, the term of this patent is extended or adjusted under 35 U.S.C. 154(b) by 477 days.

(21) Appl. No.: 11/389,804

(22) Filed: Mar. 27, 2006

(65) Prior Publication Data

US 2006/0222396 A1 Oct. 5, 2006

(30) Foreign Application Priority Data

Mar. 29, 2005 (JP) ..... 2005-095525

(51) Int. Cl.
*G03G 15/00* (2006.01)

(52) U.S. Cl. ..... 399/81; 358/1.1; 358/1.15

(58) Field of Classification Search ..... 399/8–9, 399/31, 77, 79, 81; 358/1.1, 1.15
See application file for complete search history.

(56) References Cited

U.S. PATENT DOCUMENTS 5,727,135 A * 3/1998 Webb et al. ..... 358/1.14
6,469,796 B1 * 10/2002 Leiman et al. ..... 358/1.15
6,642,943 B1 * 11/2003 Machida ..... 715/763
2004/0190057 A1 * 9/2004 Takahashi et al. ..... 358/1.15

FOREIGN PATENT DOCUMENTS

JP 2000-10741 1/2000

OTHER PUBLICATIONS

English translation of Sano (JP pub 2000-010741), published Jan. 14, 2000.*

* cited by examiner

*Primary Examiner*—David M Gray
*Assistant Examiner*—Geoffrey T Evans
(74) *Attorney, Agent, or Firm*—Gerald E. Hespos; Michael J. Porco

(57) ABSTRACT

If a designation detector detects one of icons representing peripheral equipment (image forming apparatuses) displayed on a monitor screen by a display controller in response to operator's manipulation, an operation information acquirer acquires, from the respective peripheral equipment, operation information indicating a job status of the respective peripheral equipment represented by all the icons displayed on the monitor screen. If it is judged that the peripheral equipment represented by the icon whose designation has been detected by the designation detector is in a state of processing a job, the display controller changes the display format of the icon representing a peripheral equipment in an idling state.

9 Claims, 12 Drawing Sheets

INFORMATION PROCESSING EQUIPMENT, IMAGE DISPLAY PROGRAM PRODUCT, AND IMAGE FORMING SYSTEM

BACKGROUND OF THE INVENTION

1. Field of the Invention

The present invention relates to an information processing equipment connected to peripheral equipment, an image display program product to be executed on the information processing equipment, and an image forming system provided with the peripheral equipment and the information processing equipment.

2. Description of the Related Art

Conventionally, a peripheral equipment such as a printer which is connected to an information processing equipment such as a personal computer (PC) is operative to perform a printing operation by using a printer driver compatible with the printer. Japanese Unexamined Patent Publication No. 2000-10741 discloses an information processing system for automatically judging a state of a designated printer in response to designation of printing by an operator. The information processing system is so configured as to issue an alert to the operator indicating that prompt printing by a designated printer is not executable in response to operator's designation to perform printing by the printer through a personal computer, and to display the status of use of the other printer or printers in a list.

In the above information processing system, in the case where printing by the printer designated by the operator is not executable, merely the list of the status of use of the other printer(s) is displayed. Accordingly, the operator is required to judge by himself or herself the status of use of the respective printers based on the displayed list. Thus, the operator finds it impossible or difficult to instantaneously distinguish a printer which is available for prompt printing from a printer which is not available for prompt printing. The operator has a difficulty in readily designating the printer to be used, which leaves room for improvement on operability.

SUMMARY OF THE INVENTION

In view of the above problems residing in the prior art, it is an object of the present invention to provide an improved arrangement that enables an operator to instantaneously judge whether a peripheral equipment is in a state capable of promptly executing an operation designated by the operator in response to the operator's designation to determine the peripheral equipment capable of promptly executing the operation based on the designation.

An aspect of the invention is directed to an information processing equipment connected to at least one peripheral equipment, comprising: a display controller for displaying, on a monitor screen, an icon representing the respective peripheral equipment; a designation detector for detecting whether one of the icons displayed on the monitor screen by the display controller has been designated by an operator; and an operation information acquirer for acquiring, from the peripheral equipment, operation information indicating a job status of the respective peripheral equipment represented by all the icons displayed on the monitor screen by the display controller, wherein the display controller changes a display format of the icon representing the peripheral equipment in an idling state where the peripheral equipment is not in a state of processing a job among the icons displayed on the monitor screen if the operation information acquired by the operation information acquirer indicates that the peripheral equipment represented by the icon whose designation has been detected by the designation detector is in the state of processing a job.

With the arrangement, when the designation detector detects that the one of the icons displayed on the monitor screen by the display controller has been designated by the operator, the operation information acquirer acquires, from the respective peripheral equipment representing all the icons displayed on the monitor screen, the operation information indicating the job status of the respective peripheral equipment. If it is judged that the peripheral equipment represented by the icon whose designation has been detected by the designation detector is in the state of processing a job, the display controller changes the display format of the icon representing the peripheral equipment in the idling state.

According to the arrangement, if it is judged that the peripheral equipment represented by the icon whose designation has been detected by the designation detector is in the state of processing a job, the display controller changes the display format of the icon representing the peripheral equipment in the idling state. This arrangement allows the operator to instantaneously distinguish the designated peripheral equipment which is not available for prompt operation from the other peripheral equipment which is available for prompt operation based on the change of the display format.

These and other objects, features and advantages of the present invention will become more apparent upon reading of the following detailed description along with the accompanying drawings.

DETAILED DESCRIPTION OF THE PREFERRED EMBODIMENTS

Figure 1:
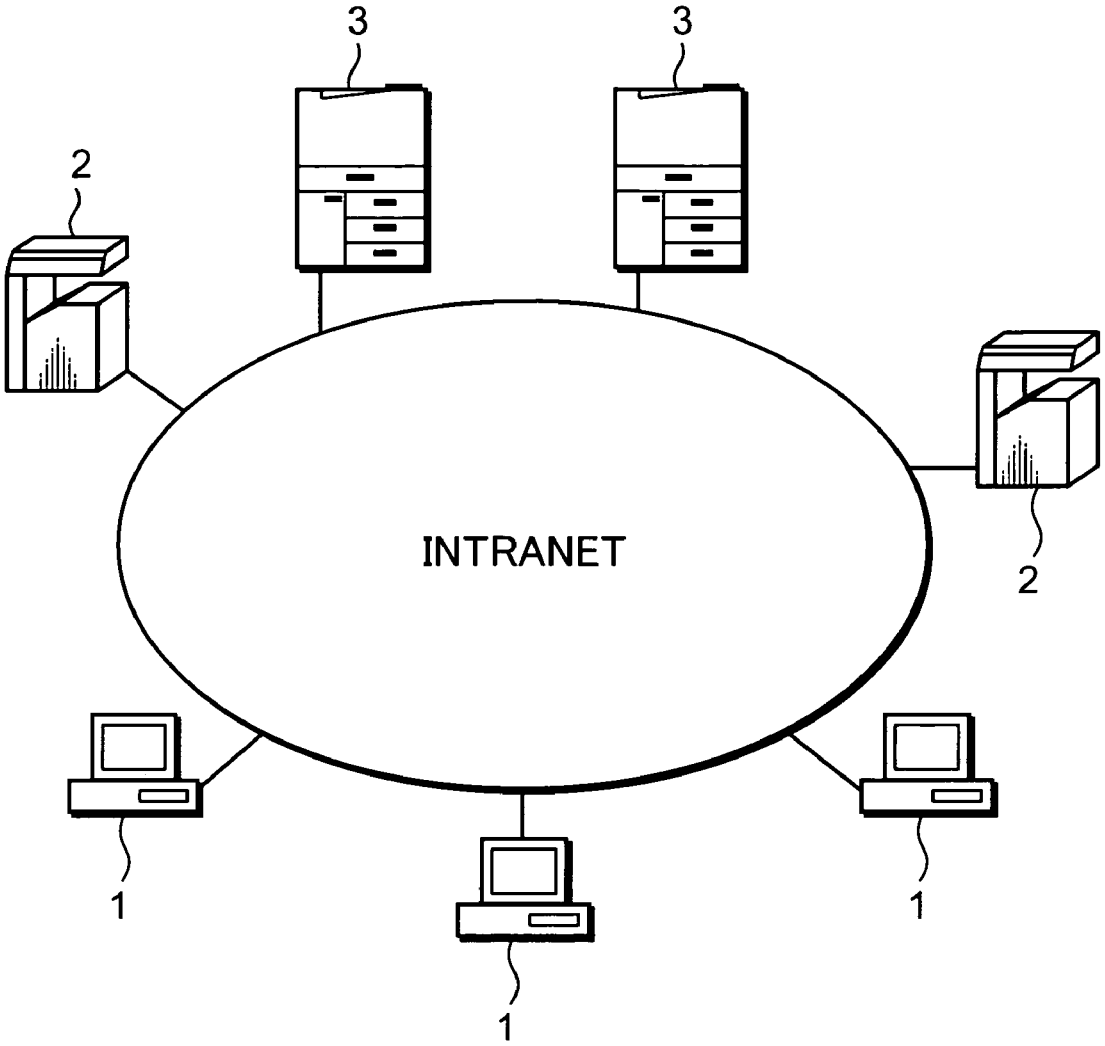
FIG. 1 is an illustration showing a network configuration, in which an information processing equipment as an embodiment of the invention is connected to image forming apparatuses on a network.

In the following, an information processing equipment, an image forming system, and an image display program according to an embodiment of the invention are described referring to the drawings. FIG. 1 is an illustration showing a network connection status of the information processing equipment and image forming apparatuses. Personal computers (PCs) 1, serving as the information processing equipment of the invention, are each communicatively connected to complex machines 2 and printers 3 on an intranet so that data to be printed is sent from each PC 1 to an intended complex machine 2 or to an intended printer 3 for printing. The complex machine 2 is a copying machine provided with functions of a printer and a scanner. The number of the PC 1, the complex machine 2, and the printer 3 connectable on the intranet can be arbitrarily set. Hereinafter, the complex machines and the printers are generally called as "image forming apparatus". The image forming system of the invention is constituted of the PC 1 and at least one image forming apparatus.

Figure 2:
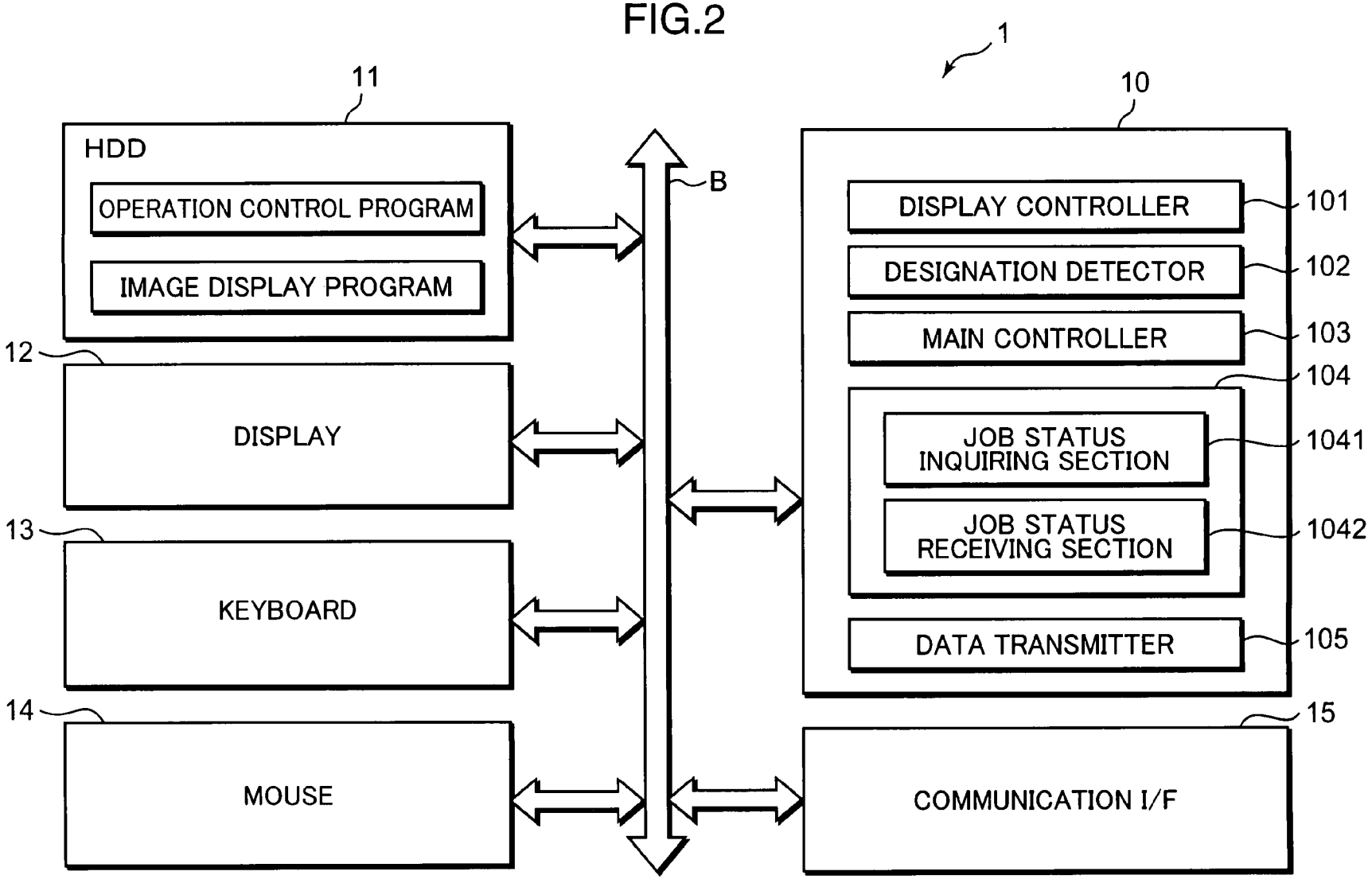
FIG. 2 is a block diagram showing mechanical and functional arrangements of a personal computer, as an example of the information processing equipment according to the embodiment of the invention.

FIG. 2 is a block diagram showing mechanical and functional arrangements of the PC 1 according to the embodiment of the invention. The PC 1 mechanically includes a bus B; and a processor 10, a hard disk drive (HDD) 11, a display 12 equipped with a monitor screen, a keyboard 13, a mouse 14, and a communication interface (I/F) 15 which are connected to each other by way of the bus B. The processor 10 reads out a program stored in the HDD 11, and has a central processing unit (CPU) and a random access memory (RAM).

The HDD 11 is a non-volatile storage for storing, on a magnetic disk, various programs e.g. an operation control program to be executed on the PC 1. The HDD 11 also stores the image display program of the invention. The PC 1 is functioned as the information processing equipment of the invention by controlling the processor 10 to operate in accordance with the image display program. The display 12, the keyboard 13, and the mouse 14 constitute an operator interface provided on the PC 1. The display 12 is an output equipment for displaying images, characters, and the like. The keyboard 13 is an input equipment for allowing an operator to input characters and the like. The mouse 14 is a pointing equipment for allowing the operator to designate an icon or a like indication displayed on the display 12.

The processor 10 is functioned as a display controller 101, a designation detector 102, a main controller 103, an operation information acquirer 104, and a data transmitter 105 based on the image display program.

The display controller 101 is adapted to control display on a screen of the display 12. For instance, the display controller 101 displays, on the screen of the display 12, icons representing the complex machines 2 and the printers 3 which are connected to the PC 1 on the intranet. The display controller 101 accepts, based on operator's designation, registration on association of an intended image forming apparatus with an icon representing the image forming apparatus to display the intended image forming apparatus in the form of the icon.

Also, in response to acquiring operation information concerning all the image forming apparatuses connected to the PC 1 including information as to whether a targeted image forming apparatus is in print job processing by the operation information acquirer 104, the display controller 101 judges whether the targeted image forming apparatus represented by the icon whose designation has been detected by the designation detector 102 is in print job processing based on the operation information acquired by the operation information acquirer 104. If the display controller 101 judges that the targeted image forming apparatus is in print job processing, the display controller 101 changes the display format of the icon representing the image forming apparatus which is not in print job processing on the screen of the display 12. Various techniques are applied to change the display format of the icon such as intermittent display of the icon, display of the icon in a color different from the color of the icon representing the image forming apparatus in print job processing, enlarged display of the icon, and the like. Hereinafter, the state of the image forming apparatus which is not in print job processing is called as "idling state".

Also, if the targeted image forming apparatus is judged to be in print job processing based on the operation information, the display controller 101 displays a message or the like indicating that the image forming apparatus is in print job processing, for instance, in the vicinity of the icon representing the targeted image forming apparatus on the screen of the display 12 to notify the operator that the image forming apparatus represented by the icon is in print job processing.

The designation detector 102 detects whether one of the icons displayed on the screen of the display 12 has been designated by operator's manipulation of the mouse 14 e.g. a double-click operation on a left part of the mouse 14.

The main controller 103 controls overall operations of the PC 1. In the case where the operation information acquired by the operation information acquirer 104 indicates that a targeted image forming apparatus represented by the icon whose designation has been detected by the designation detector 102 is in an idling state, in other words, the designated image forming apparatus is available for prompt printing, the main controller 103 controls the designated image forming apparatus to execute a printing operation in response to the operator's designation. If, on the other hand, the operation information acquired by the operation information acquirer 104 indicates that the targeted image forming apparatus represented by the icon whose designation has been detected by the designation detector 102 is already in a state of print job processing, namely, the targeted image forming apparatus is not available for prompt printing, the main controller 103 controls an image forming apparatus in an idling state to execute a printing operation in response to the operator's designation on behalf of the designated image forming apparatus which is in the state of print job processing.

The operation information acquirer 104 includes a job status inquiring section 1041 and a job status receiving section 1042. The job status inquiring section 1041 requests information as to whether each one of the image forming apparatus represented by all the icons displayed on the screen of the display 12 is in print job processing in response to detection of one of the image forming apparatuses whose designation by the operator has been detected by the designation detector 102. The job status receiving section 1042 receives operation information from the respective image forming apparatuses as to whether the each one of the image forming apparatuses is in print job processing in response to the request from the job status inquiring section 1041.

The data transmitter 105 sends data to be printed, and a printout command to the individual image forming apparatuses connected to the PC 1 on the intranet via the communications I/F 15.

In the embodiment, the processor 10 is functioned as the display controller 101, the designation detector 102, the main controller 103, the operation information acquirer 104, and the data transmitter 105 in accordance with the image display program stored in the HDD 11. Alternatively, the respective elements 101 through 105 may be constituted of circuits or equivalent elements, individually.

Figure 3:
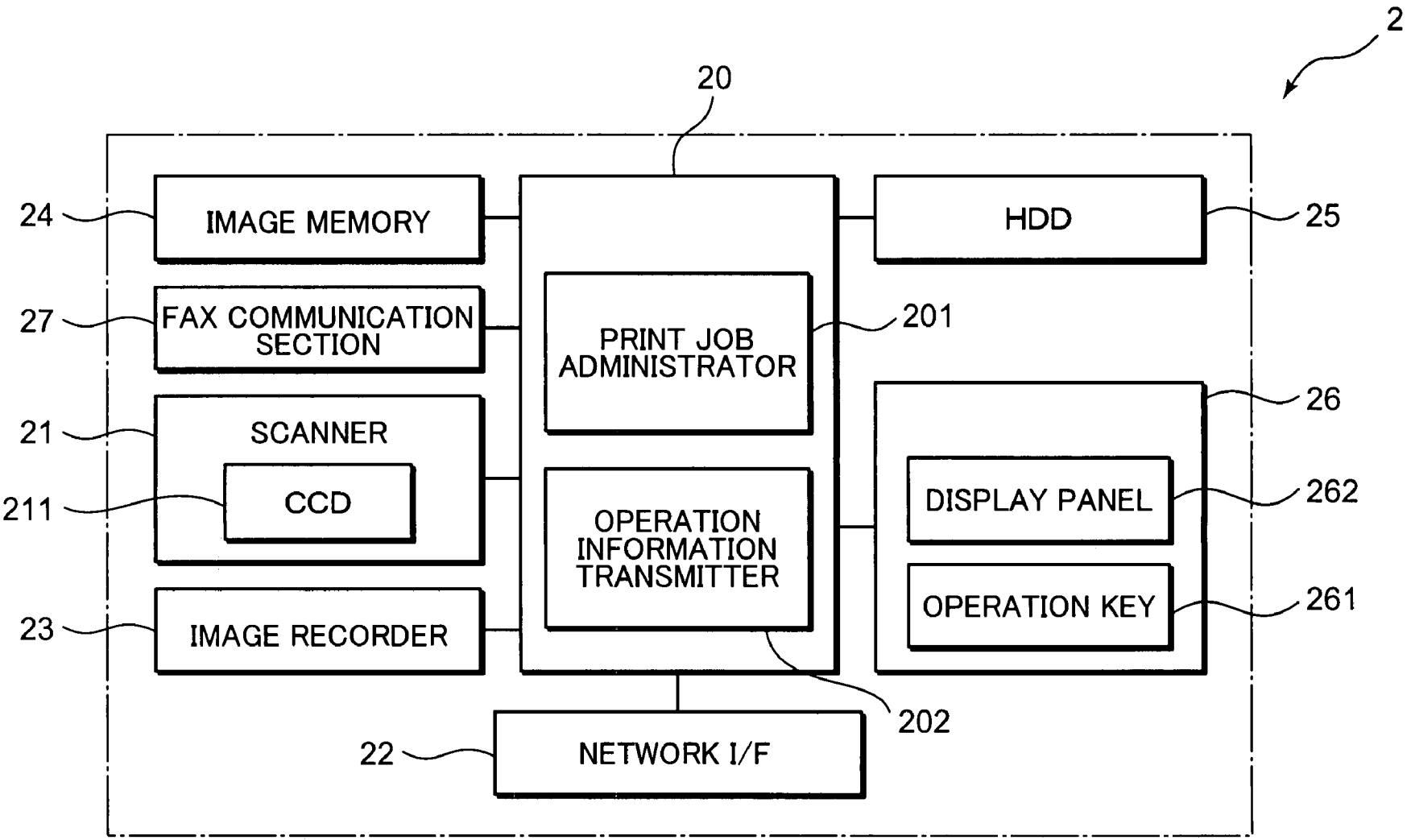
FIG. 3 is a block diagram showing a schematic construction of a complex machine, as an example of the image forming apparatus.

An arrangement of the complex machine 2 is described referring to FIG. 3. FIG. 3 is block diagram schematically showing the arrangement of the complex machine 2. The arrangement of the printer 3 is substantially the same as that of the complex machine 2 except that components corresponding to a scanner 21, an HDD 25, and a fax communication section 27 of the complex machine 2 are not provided.

The complex machine 2 includes a main controller 20 for controlling overall operations of the complex machine 2, the scanner 21 equipped with a CCD 211 for instance for reading a document image, and an image recorder 23 for recording an image on a recording sheet based on the image data read by the scanner 21 or data to be printed, which is sent from the PC 1 via a network I/F 22.

The main controller 20 includes a well-known CPU for performing a logic operation, an ROM in which various programs for controlling the CPU are stored in advance, and an RAM for temporarily storing various data while the complex machine 2 is in operation. The main controller 20 integrally controls the image recorder 23 and the like to execute an image recording operation and the like in accordance with the program stored therein, and also serves as a print job administrator 201 and an operation information transmitter 202.

The print job administrator 201 administers a print job to be executed by the image recorder 23. In response to receiving a request as to whether the complex machine 2 is in print job processing from the job status inquiring section 104 of the PC 1, the operation information transmitter 202 acquires, from the print job administrator 201, the operation information as to whether the requested complex machine 2 is in print job processing at the time of receiving the request, and sends the acquired operation information to the PC 1.

Also, the main controller 20 is connected to an image memory 24 and to the HDD 25. The image memory 24 temporarily stores the image data read by the scanner 21, and the data to be printed, which is sent from the PC 1 for printing by the image recorder 23. The HDD 25 stores the image data read by the scanner 21, and the like.

The complex machine 2 further includes an operating section 26, and the fax communication section 27 for performing various processing necessary for fax communications. The operating section 26 includes an operation key 261 for enabling the operator to designate various settings for the complex machine 2, and a display panel 262 with an LCD for displaying an operation status of the complex machine 2 so that the operator can recognize the operation status of the complex machine 2.

Figure 4:
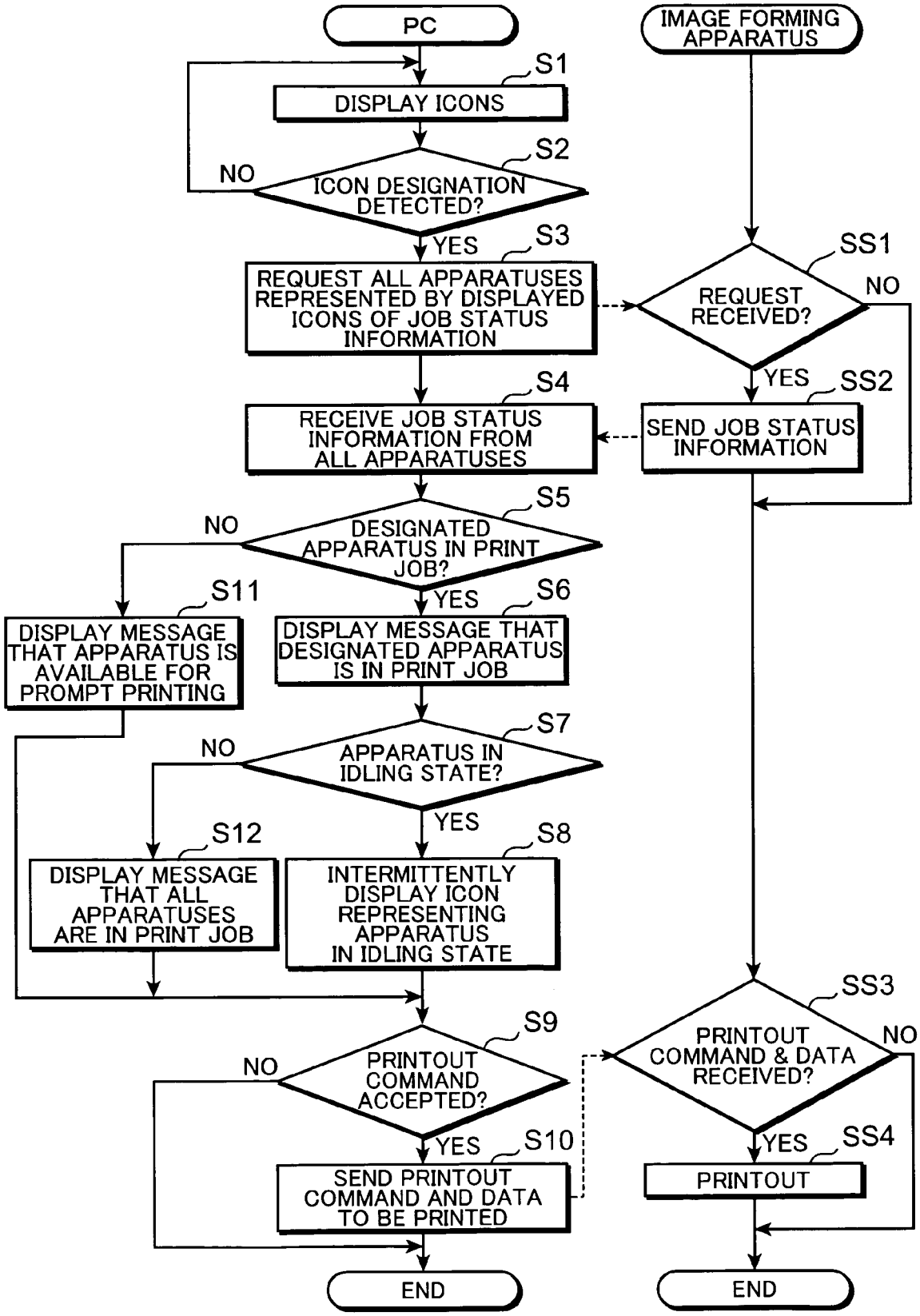
FIG. 4 is a flowchart showing a first embodiment on icon display control of displaying icons indicating job statuses of the respective image forming apparatuses according to an image forming system of the invention.

Next, a first embodiment of icon display control of displaying icons in accordance with operation statuses of the respective image forming apparatuses in the image forming system of the invention is described. Hereinafter, the complex machine 2 is called as "image forming apparatus" as a general term. FIG. 4 is a flowchart showing a processing flow in controlling the icon display in the first embodiment. FIGS. 5 through 9 are illustrations showing examples of screen images on the display 12.

Figure 5:
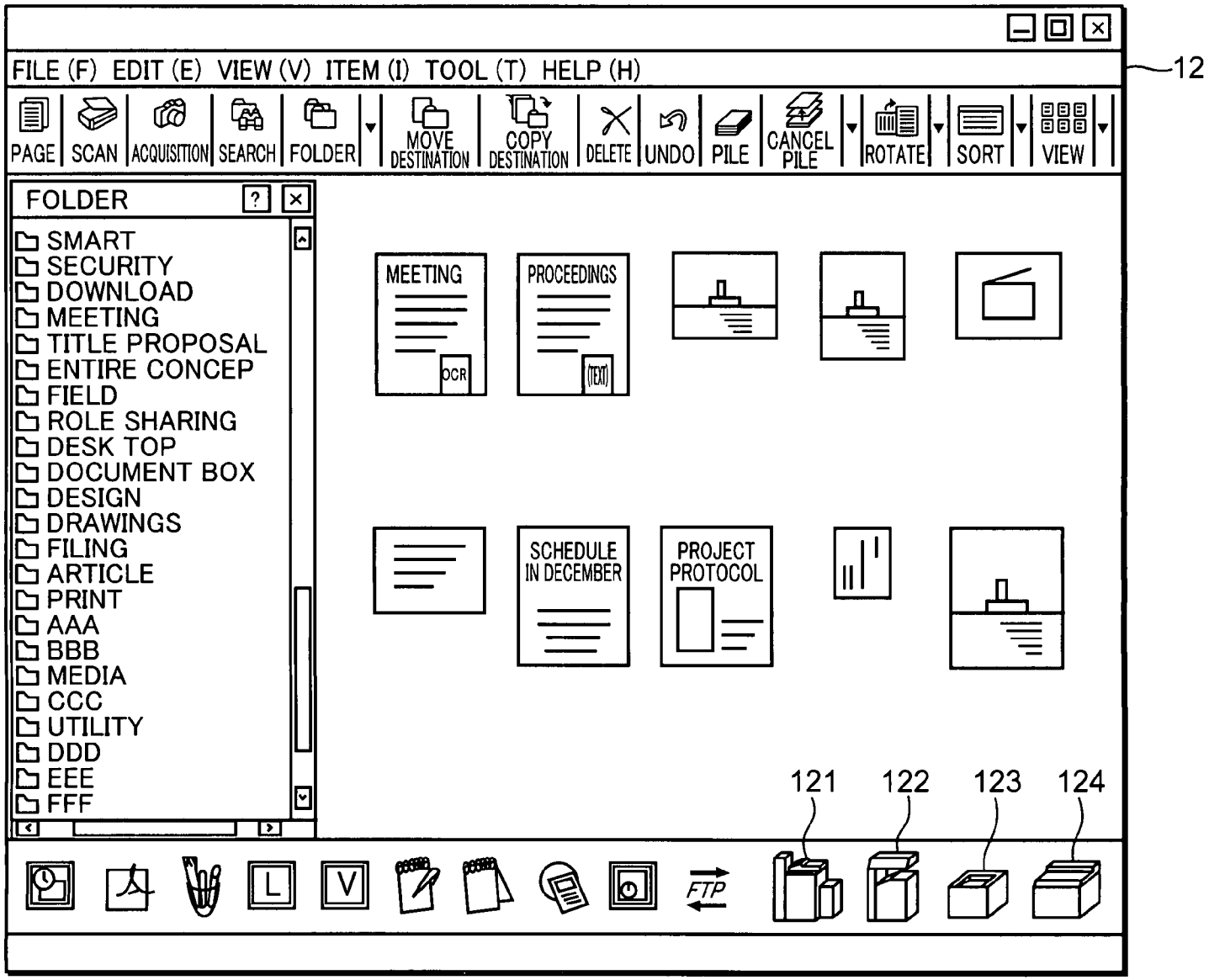
FIG. 5 is an illustration showing an example of a screen image on the display.

As shown in FIG. 5, for instance, while icons 121 through 124 representing individual image forming apparatuses connected to the PC 1 on the intranet are displayed on the screen of the display 12 by the display controller 101 (Step S1), in response to detection of one of the icons 121 through 124 by operator's manipulation of the mouse 14 by the designation detector 102 (YES in Step S2), the job status inquiring section 1041 of the operation information acquirer 104 requests each of the image forming apparatuses represented by the icons 121 through 124 displayed on the screen of the display 12 by the display controller 101 of information as to whether the each one of the image forming apparatuses is in print job processing (Step S3).

Upon receiving the request from the PC 1 (YES in Step SS1), the operation information transmitter 202 of the respective image forming apparatuses acquires, from the print job administrator 201, the operation information i.e. a job status as to whether the respective image forming apparatuses is in print job processing at the time of receiving the request, and sends the acquired operation information to the PC 1 (Step SS2.)

Figure 6:
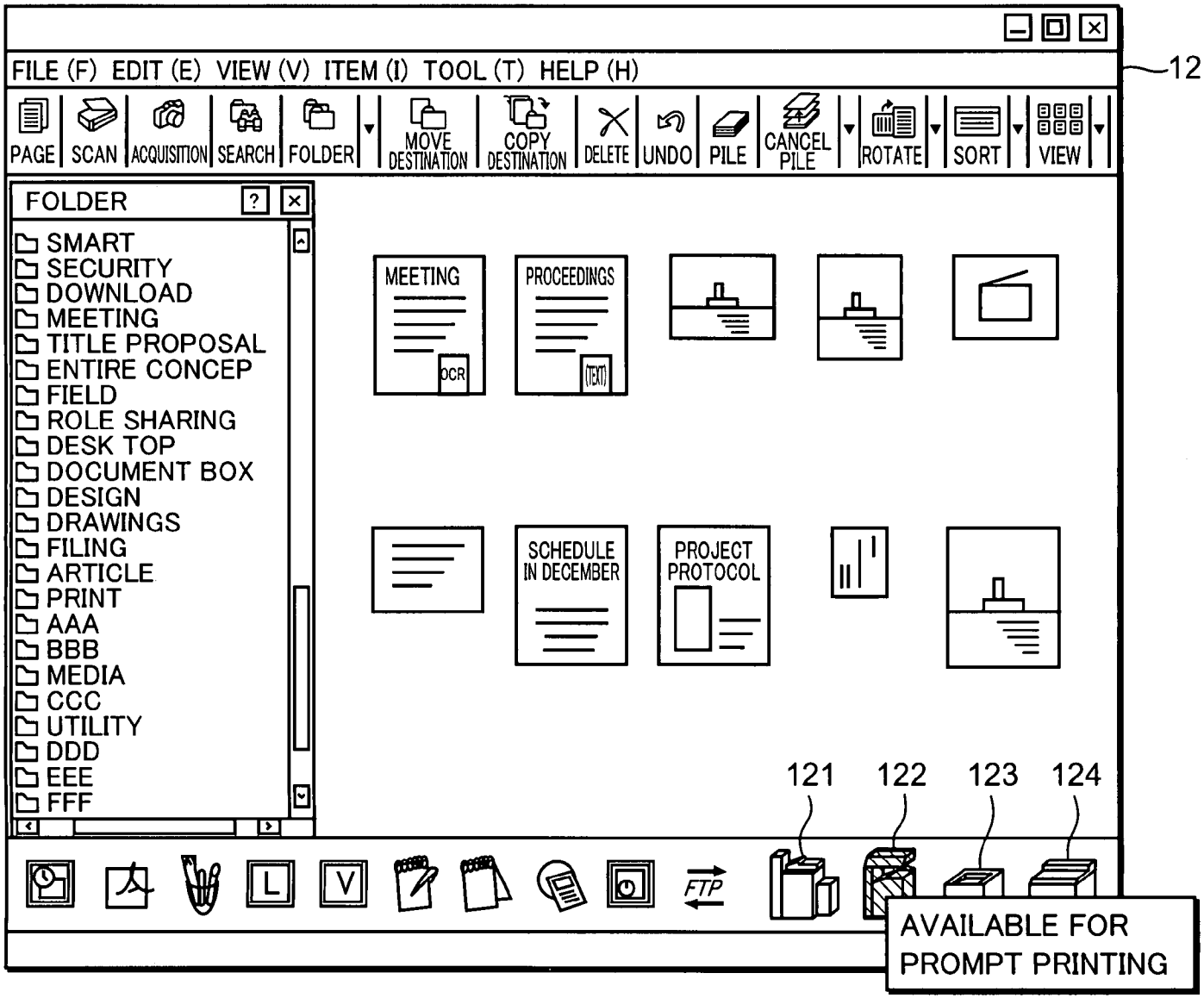
FIG. 6 is an illustration showing another example of a screen image on the display.

After the job status receiving section 1042 of the PC 1 receives the operation information from the individual image forming apparatus (Step S4), the display controller 101 judges, based on the received operation information, whether the targeted image forming apparatus represented by the icon whose designation has been detected in Step S2 is in print job processing (Step S5). If it is judged that the designated image forming apparatus is in an idling state (NO in Step S5), the display controller 101 controls the display 12 to display, on the screen thereof, the icon 122 representing the designated image forming apparatus in a color different from the color of the other icons 121, 123, and 124, for instance, as shown in FIG. 6, and to display a message indicating that the designated image forming apparatus is available for prompt printing (Step S11).

Figure 7:
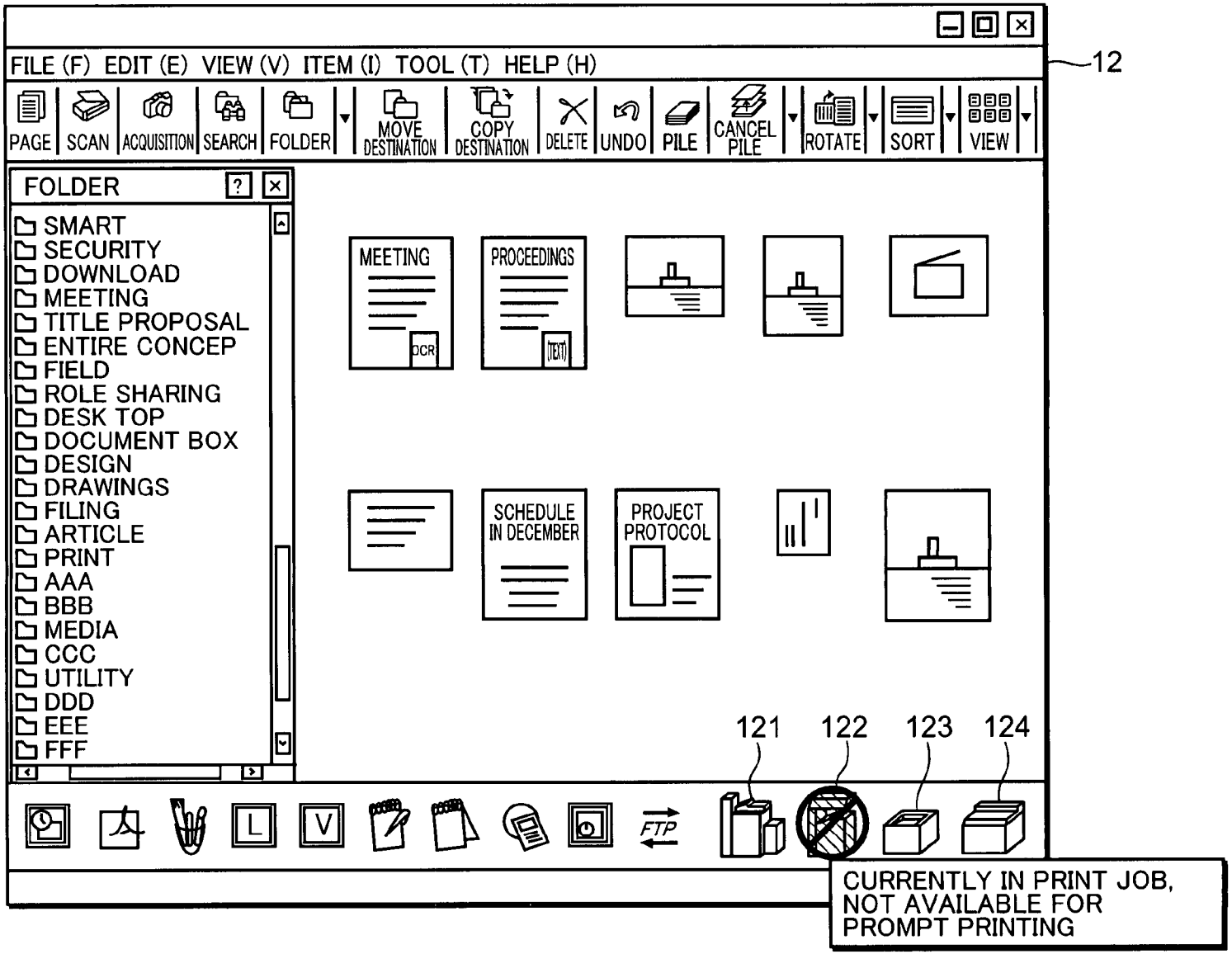
FIG. 7 is an illustration showing yet another example of a screen image on the display.

If, on the other hand, it is judged that the designated image forming apparatus is in print job processing based on the acquired operation information (YES in Step S5), as shown in FIG. 7, for instance, the display controller 101 controls the display 12 to display, on the screen thereof, a message indicating that the designated image forming apparatus is not available for prompt printing (Step S6). At this time, as shown in FIG. 7, for instance, it is preferable to display the icon 122 representing the designated image forming apparatus in such a display format that the operator can readily recognize that the apparatus is not available for prompt printing.

Figure 8:
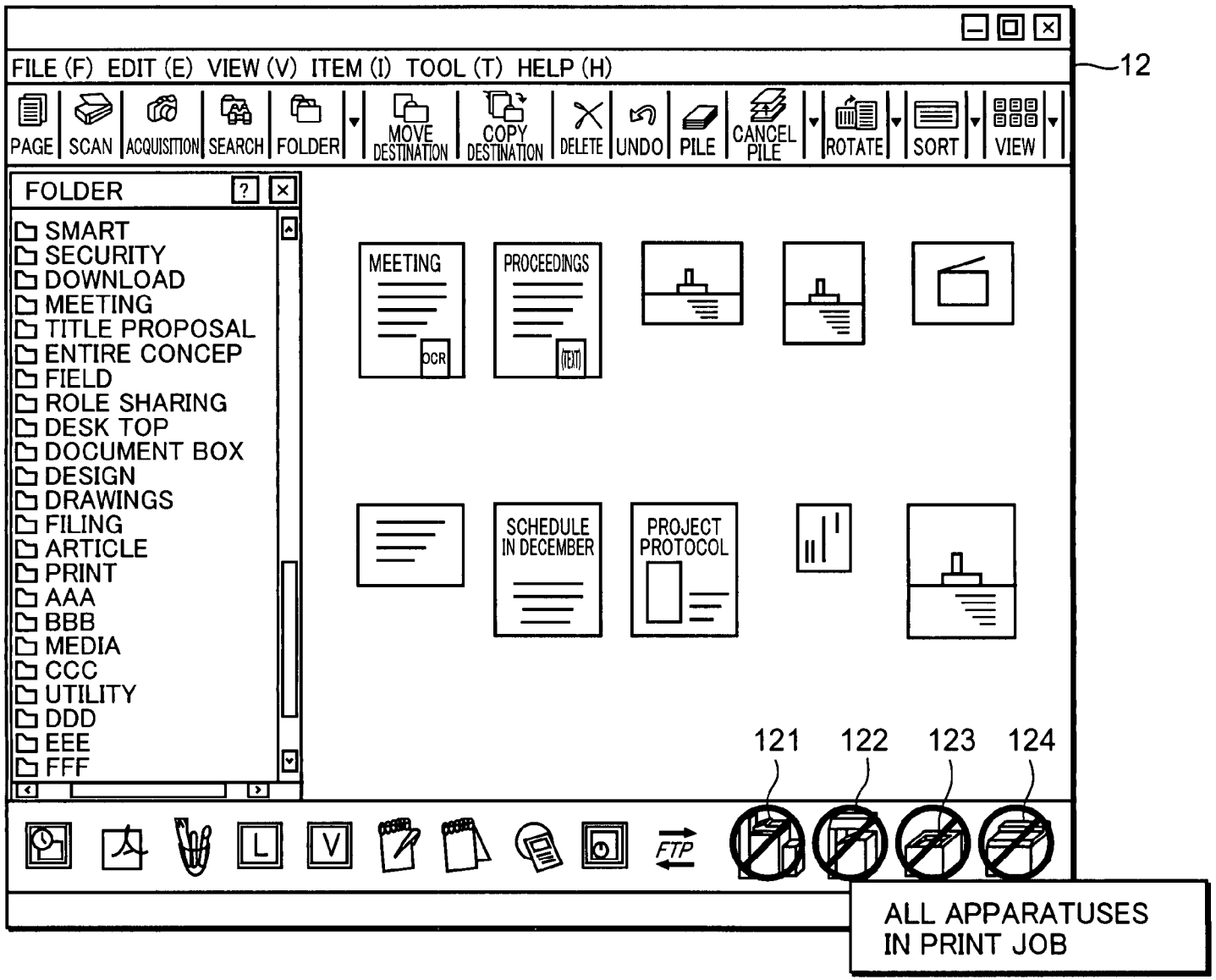
FIG. 8 is an illustration showing a further example of a screen image on the display.

Subsequently, the display controller 101 judges whether there exists an image forming apparatus in an idling state based on the operation information acquired from the respective image forming apparatuses (Step S7). If it is judged that all the image forming apparatuses are in a state of print job processing, and accordingly, there is no image forming apparatus available for prompt printing (NO in Step S7), the display controller 101 causes the display 12 to display, on the screen thereof, a message indicating that all the image forming apparatuses are in a state of print job processing, as shown in FIG. 8, for instance (Step S12).

Figure 9:
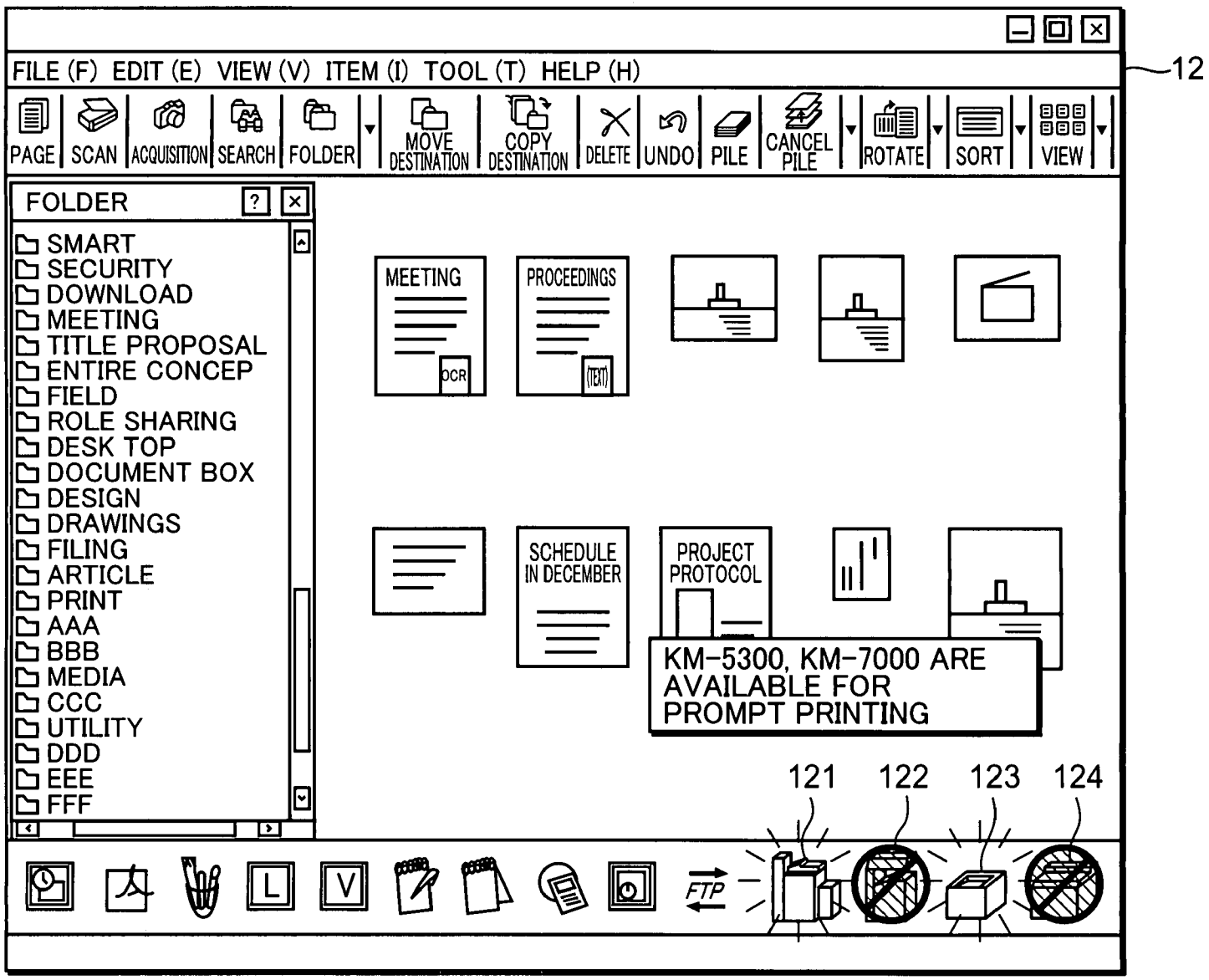
FIG. 9 is an illustration showing a yet further example of a screen image on the display.

If it is judged that there is an image forming apparatus or apparatuses in an idling state (YES in Step S7), the display controller 101 causes the display 12 to intermittently display, on the screen thereof, the icon or icons representing the image forming apparatus or apparatuses in an idling state (Step S8). Alternatively, as shown in FIG. 9, the display controller 101 may control the display 12 to display, on the screen thereof, the model names of the image forming apparatuses available for prompt printing.

After displaying the message indicating that the image forming apparatus designated by the operator is available for prompt printing (Step S11), or displaying the message indicating that all the connected image forming apparatuses are in print job processing, and accordingly are not available for prompt printing (Step S12), or intermittently displaying the icon or icons representing the candidate image forming apparatus or apparatuses in an idling state to indicate that the image forming apparatus or apparatuses is or are available for prompt printing (Step S8), in response to placing one of data D displayed as thumbnail images on the screen of the display 12 over the icon representing an intended image forming apparatus by operator's manipulation e.g. a dragging operation of the mouse 14, designation of the intended image forming apparatus by the operator is detected by the designation detector 102, the data D to be printed by the designated image forming apparatus is specified, and a judgment as to whether a printout command of the data D to be printed has been accepted is made (Step S9). If the operator's designation of the intended image forming apparatus is detected, and the data D to be printed is specified, and the printout command is accepted (YES in Step S9), the main controller 103 controls the data transmitter 105 to send the printout command and the data D to be printed to the image forming apparatus designated by the operator (Step S10).

Upon receiving the printout command and the data D to be printed (YES in Step SS3), the main controller 20 of the image forming apparatus controls the image recorder 23 to print out an image based on the data D to be printed (Step SS4).

Figure 10:
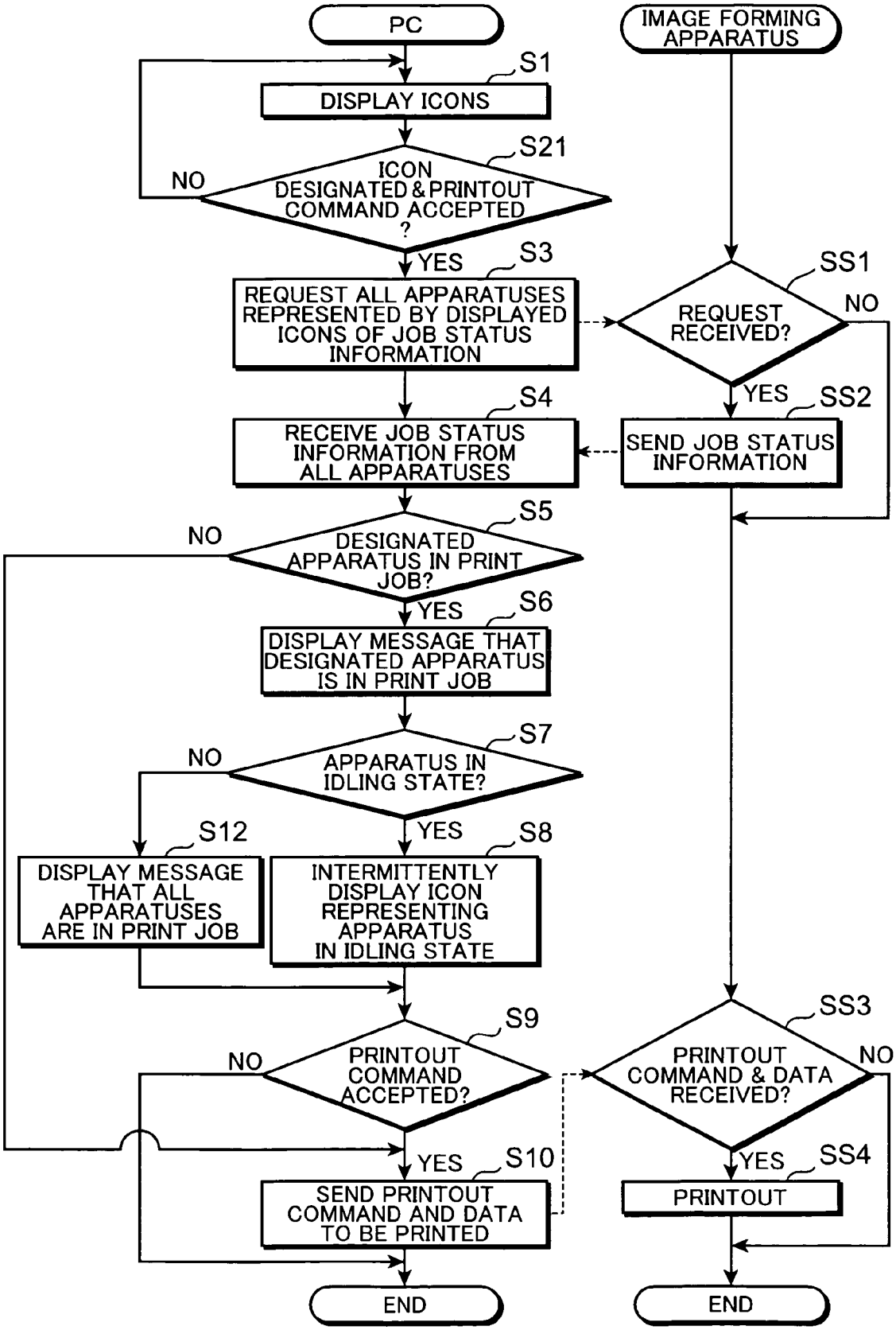
FIG. 10 is a flowchart showing a second embodiment on icon display control of displaying icons indicating job statuses of the respective image forming apparatuses according to the image forming system of the invention.

Now, a second embodiment of icon display control of displaying icons in accordance with operation statuses of the respective image forming apparatuses in the image forming system of the invention is described. FIG. 10 is a flowchart showing a processing flow in controlling icon display in the second embodiment. Steps identical or equivalent to those in the first embodiment shown in FIG. 4 are denoted at the same step numbers, and description thereof is omitted herein.

In the first embodiment, if it is judged that the image forming apparatus represented by the icon designated by the operator is in an idling state (NO in Step S5), the routine goes to Step S11, where the display controller 101 controls the display 12 to display, on the screen thereof, the message indicating that the designated image forming apparatus is available for prompt printing. Then, the routine waits until the judgment result in Step S9 is affirmative, namely, until the designation detector 102 detects designation of an icon representing an intended image forming apparatus, data D to be printed is specified, and a printout command is accepted (YES in Step S9). If the judgment result in Step S9 is affirmative, the display controller 101 allows the designated image forming apparatus to print out the data D to be printed (Step S10).

In the second embodiment, as shown in the flowchart of FIG. 10, if it is judged that the image forming apparatus represented by the icon designated by the operator is in an idling state, and accordingly is available for prompt printing (NO in Step S5), the routine directly goes to Step S10 where the main controller 101 allows the designated image forming apparatus to print out the data to be printed, while skipping Step S9, in other words, without waiting for operator's designation of an icon representing an intended image forming apparatus, specifying of data to be printed by the intended image forming apparatus, and acceptance of a printout command. Alternatively, the display controller 101 may display a message indicating that the designated image forming apparatus is available for prompt printing.

In the second embodiment, if it is judged that the image forming apparatus which has been designated by the operator for the first time is available for prompt printing, the main controller 103 controls the designated image forming apparatus to execute printing promptly, without requesting the operator of an additional manipulation. If, on the other hand, it is judged that the designated image forming apparatus is not available for prompt printing, an icon or icons representing a candidate image forming apparatus or apparatuses available for prompt printing is or are displayed, or a message is displayed on the screen of the display 12, indicating that all the image forming apparatuses connected to the PC 1 are in print job processing and accordingly are not available for prompt printing. This arrangement prompts the operator to designate an image forming apparatus available for prompt printing after the judgment that the first-time designated image forming apparatus is not available for prompt printing. This provides the operator with improved operability.

Figure 11:
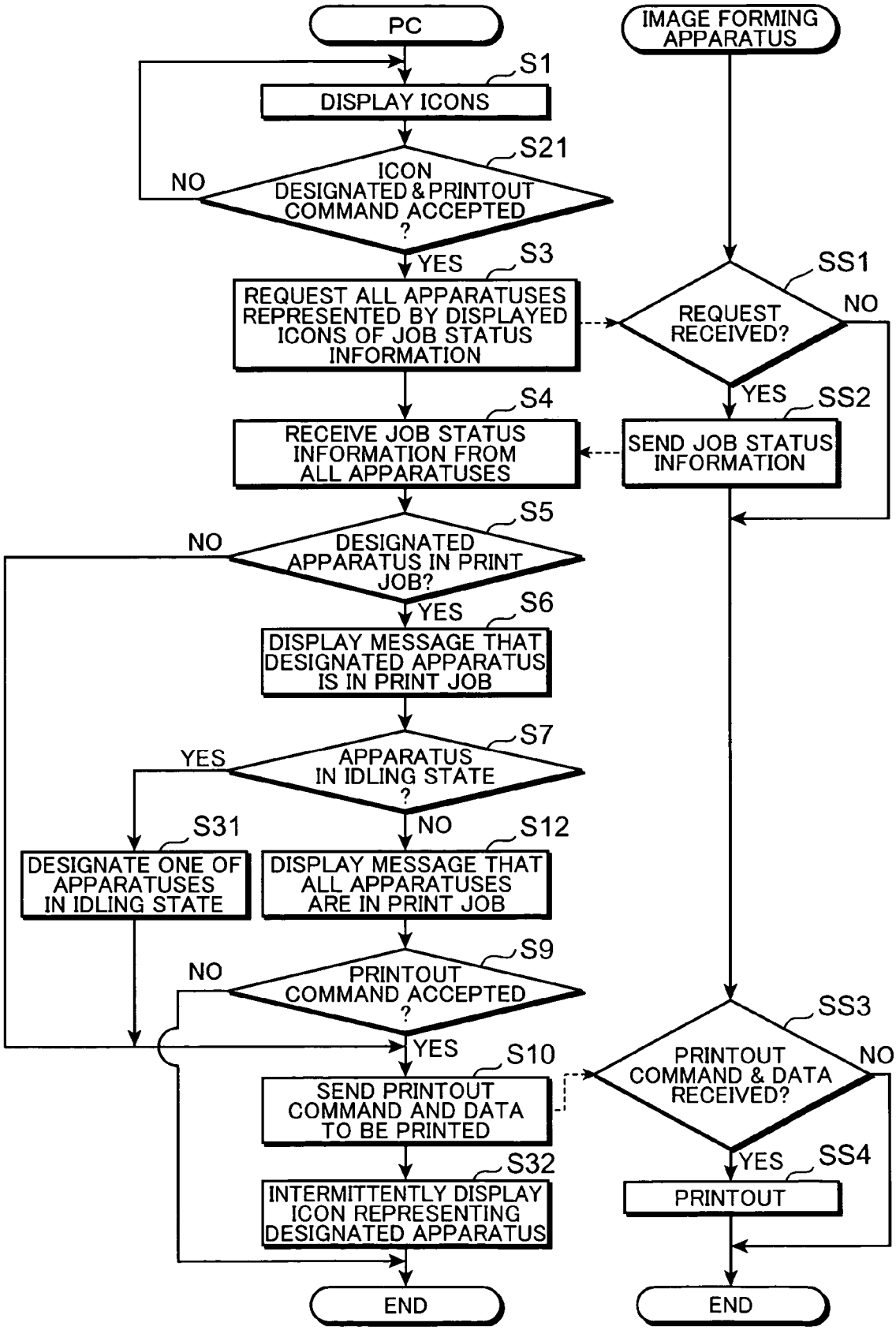
FIG. 11 is a flowchart showing a third embodiment on icon display control of displaying icons indicating job statuses of the respective image forming apparatuses according to the image forming system of the invention.

Next, a third embodiment of icon display control of displaying icons in accordance with operation statuses of the respective image forming apparatuses in the image forming system of the invention is described. FIG. 11 is a flowchart showing a processing flow in controlling icon display in the third embodiment. Steps identical or equivalent to those in the first and second embodiments shown in FIGS. 4 and 10 are denoted at the same step numbers, and description thereof is omitted herein.

Figure 12:
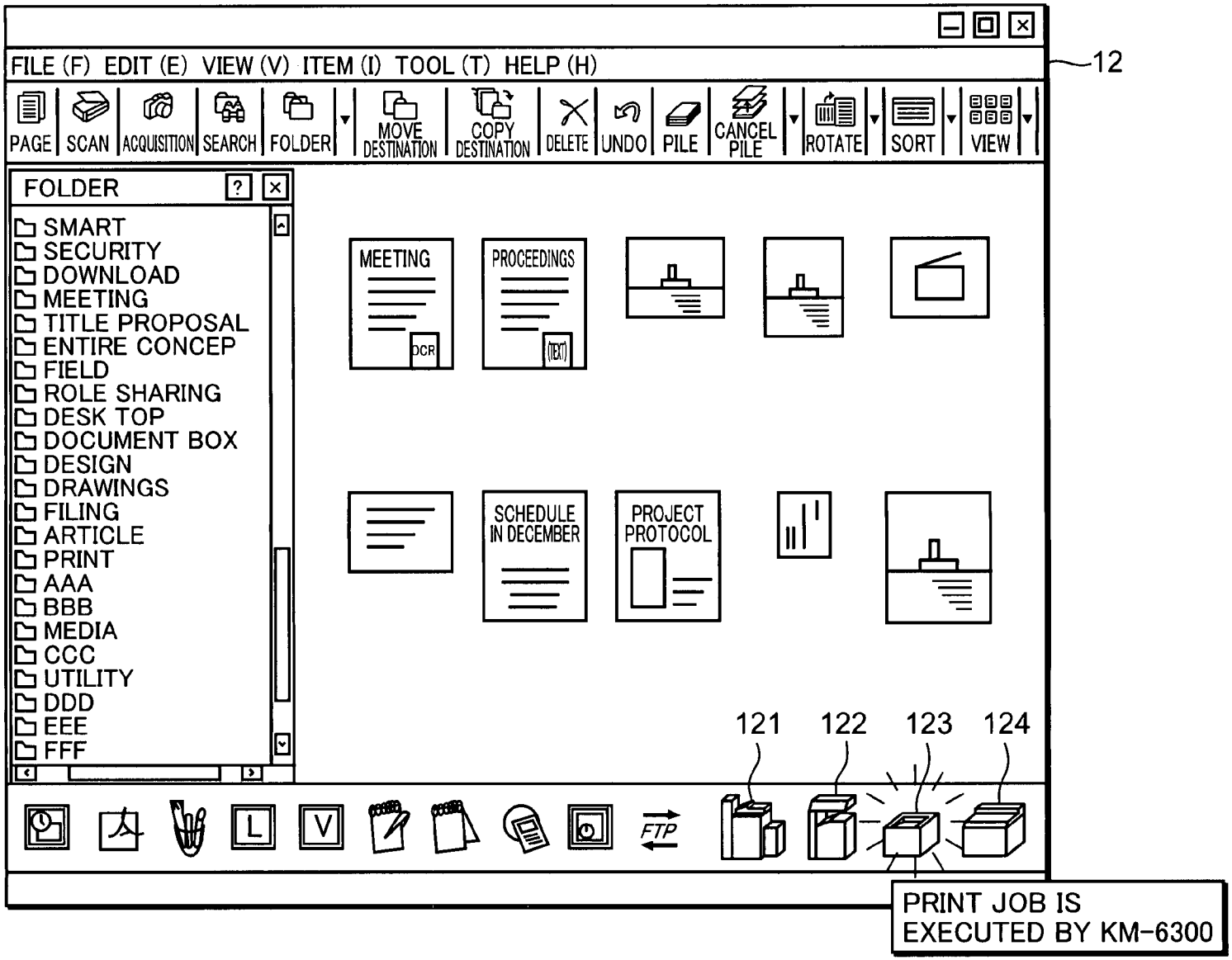
FIG. 12 is an illustration showing an example of a screen image on the display.

In the second embodiment, if it is judged that the image forming apparatus which has been designated by the operator for the first time is available for prompt printing, the main controller 103 controls the designated image forming apparatus to execute printing promptly, without requesting the operator of an additional manipulation. In the third embodiment, after a judgment that the image forming apparatus which has been designated by the operator for the first time is not available for prompt printing (YES in Step S5), if it is judged that there is an image forming apparatus which is in an idling state and accordingly available for prompt printing (YES in Step S7), the main controller 103 automatically selects one of the image forming apparatuses available for prompt printing, without requesting the operator of a further designation on an image forming apparatus for printout (Step S31), and then, the data to be printed, and a printout command are sent to the designated image forming apparatus for printout (Step S10). Thereafter, the display controller 101 controls the display 12 to intermittently display, on the screen thereof, the icon representing the automatically selected image forming apparatus, as shown in FIG. 12, for instance, so that the operator can immediately recognize the image forming apparatus which executes a print job, while displaying the model name of the image forming apparatus, as well as a message indicating that printout is executed by the designated image forming apparatus (Step S32).

The above arrangement allows the image forming apparatus available for prompt printing to execute a print job with a reduced number of operator's manipulations.

The invention is not limited to the foregoing embodiments, but is applicable to various modifications. For instance, the embodiments describe the case that the PC 1 is connected to the complex machines 2 and/or printers 3 on the intranet. Alternatively, the PC 1 may be connected to the complex machines 2 and/or printers 3 via a local area network (LAN) or a like configuration.

The embodiments describe the case that the PC 1 is connected to the complex machines 2 and/or printers 3 on the intranet, and that icon display control is performed depending on a judgment as to whether the image forming apparatuses such as the complex machines 2 and the printers 3 are in print job processing. Alternatively, the image forming apparatus may be a peripheral equipment other than the complex machines 2 and the printers 3 such as a scanner, as far as the peripheral equipment is connectable to the PC 1. Further alternatively, the icon display control may be performed depending on a judgment as to whether the peripheral equipment is in processing a certain job.

The embodiment of the invention has been exemplarily described by the arrangements and processing shown in FIGS. 1 through 12. The invention, however, is not limited to the arrangements and processing described in the foregoing.

In general, the routines executed to implement the embodiment of the invention, whether implemented as part of an operating system or a specific application, component, program, object, module or sequence of instructions will be referred to as "programs". The program comprises one or more instructions that are resident at various times in various memories and storage equipment in a computer, and that cause the computer to perform the steps necessary to execute steps or elements embodying the various aspects of the invention.

The embodiment of the invention has been and will be described in the context of functioning the computer and computer system. However, those skilled in the art will appreciate that various embodiments of the invention are capable of being distributed as a program product in a variety of forms, and that the invention is applied equally regardless of the particular type of signal bearing media used to actually carry out the distribution. Examples of signal bearing media include but are not limited to recordable type media such as volatile and non-volatile memory equipment, floppy and other removable disks, hard disk drives, optical disks (e.g., CD-ROMs, DVDs, etc.), among others, and transmission type media such as digital and analog communication links, including the Internet.

To summarize the invention, an aspect of the invention is directed to information processing equipment connected to at least one peripheral equipment. The information processing equipment comprises: a display controller for displaying, on a monitor screen, an icon representing the respective peripheral equipment; a designation detector for detecting whether one of the icons displayed on the monitor screen by the display controller has been designated by an operator; and an operation information acquirer for acquiring, from the peripheral equipment, operation information indicating a job status of the respective peripheral equipment represented by all the icons displayed on the monitor screen by the display controller, wherein the display controller changes a display format of the icon representing the peripheral equipment in an idling state where the peripheral equipment is not in a state of processing a job among the icons displayed on the monitor screen if the operation information acquired by the operation information acquirer indicates that the peripheral equipment represented by the icon whose designation has been detected by the designation detector is in the state of processing a job.

Another aspect of the invention is directed to an image display program product for displaying an image. The image display program product comprises: an image display program which causes an information processing equipment connected to at least one peripheral equipment to function as: a display controller for displaying, on a monitor screen, an icon representing the respective peripheral equipment; a designation detector for detecting whether one of the icons displayed on the monitor screen by the display controller has been designated by an operator; and an operation information acquirer for acquiring, from the peripheral equipment, operation information indicating a job status of the respective peripheral equipment represented by all the icons displayed on the monitor screen by the display controller, wherein the display controller changes a display format of the icon representing the peripheral equipment in an idling state where the peripheral equipment is not in a state of processing a job among the icons displayed on the monitor screen if the operation information acquired by the operation information acquirer indicates that the peripheral equipment represented by the icon whose designation has been detected by the designation detector is in the state of processing a job; and a signal bearing media bearing the image display program.

Yet another aspect of the invention is directed to an image forming system comprising: an information processing equipment; and at least one peripheral equipment connected to the information processing equipment, the information processing equipment including: a display controller for displaying, on a monitor screen, an icon representing the respective peripheral equipment, a designation detector for detecting whether one of the icons displayed on the monitor screen by the display controller has been designated by an operator, and an operation information acquirer for acquiring, from the peripheral equipment, operation information indicating a job status of the respective peripheral equipment represented by all the icons displayed on the monitor screen by the display controller, wherein the display controller changes a display format of the icon representing the peripheral equipment in an idling state where the peripheral equipment is not in a state of processing a job among the icons displayed on the monitor screen if the operation information acquired by the operation information acquirer indicates that the peripheral equipment represented by the icon whose designation has been detected by the designation detector is in the state of processing a job, the peripheral equipment including an operation information transmitter for sending, to the information processing equipment, the operation information of the peripheral equipment as to whether the peripheral equipment is in the state of processing a job in response to a request from the information processing equipment as to whether the peripheral equipment is in the state of processing a job.

With the above arrangements, if it is judged that the peripheral equipment represented by the icon designated by the operator is in the state of processing of a job, the display controller changes the display format of the icon representing the peripheral equipment in the idling state. This allow the operator to instantaneously distinguish the designated peripheral equipment which is not available for prompt operation from the other peripheral equipment which is available for prompt operation based on the change of the display format.

Preferably, the display controller may display, on the monitor screen, an indication to notify the operator of the peripheral equipment in the state of processing a job based on the acquired operation information.

With this arrangement, in response to the operator's designation of the one of the icons displayed on the monitor screen, the display controller displays, on the monitor screen, the indication to notify the operator of the peripheral equipment in the state of processing a job. This enables the operator to notify the peripheral equipment which is in the state of processing a job, and accordingly is not available for prompt operation in response to the operator's designation.

Preferably, the display controller may display, on the monitor screen, an indication to notify the operator of the peripheral equipment in the idling state based on the acquired operation information.

With the arrangement, in response to the operator's designation of the one of the icons displayed on the monitor screen, the display controller displays, on the monitor screen, the indication to notify the operator of the peripheral equipment in the idling state. This arrangement enables the operator to clearly notify the peripheral equipment available for prompt operation, even if the peripheral equipment represented by the designated icon is not available for prompt operation in response to the operator's designation.

Preferably, the information processing equipment may further comprise a controller for performing, if it is judged that the peripheral equipment represented by the icon whose designation has been detected by the designation detector is in the idling state, a processing necessary for causing the peripheral equipment to execute an operation based on a designation by the operator.

With the arrangement, in the case where the one of the icons displayed on the monitor screen has been designated by the operator, and if it is judged that the peripheral equipment represented by the designated icon is in the idling state, the peripheral equipment is allowed to promptly perform the operation based on the designation by the operator, without requesting the operator of an additional manipulation. This provides the operator with an improved operability.

Preferably, the information processing equipment may further comprise a controller for performing a processing necessary for causing the peripheral equipment in the idling state to execute an operation based on a designation by the operator if it is judged that the peripheral equipment represented by the icon whose designation has been detected by the designation detector is in the state of processing a job.

With the arrangement, in the case where the one of the icons displayed on the monitor screen has been designated by the operator, and if it is judged that the peripheral equipment represented by the designated icon is in the state of processing a job, performed is processing necessary for causing the peripheral equipment in the idling state to execute the operation based on the designation by the operator. This allows the peripheral equipment in the idling state to promptly perform the operation without requesting the operator to designate a peripheral equipment in the idling state to perform the operation on behalf of the peripheral equipment which has been judged to be in the state of processing a job. This provides the operator with a further improved operability.

This application is based on Japanese Patent Application No. 2005-95525 filed on Mar. 29, 2005, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An item of information processing equipment connected to at least one item of peripheral equipment, comprising:

a display controller for displaying, on a monitor screen, an icon representing each respective item of peripheral equipment;

a designation detector for detecting whether one of the icons displayed on the monitor screen by the display controller has been designated by an operator; and an operation information acquirer for acquiring, from each item of peripheral equipment, operation information indicating a job status of the respective item of peripheral equipment represented by each of the icons displayed on the monitor screen by the display controller, wherein the display controller judges whether the item of peripheral equipment represented by the icon is in the state of processing a job based on the operation information acquired by the operation information acquirer and then changes a display format of the icon on the monitor screen whose designation has been detected by the designation detector, to an image having a display format indicating a state of processing a job when the item of peripheral equipment represented by the icon, whose designation has been detected by the designation detector, is in the state of processing a job and displays, on the monitor screen, an indication indicating that the designated peripheral equipment is not available for prompt processing, and the display controller further changes a display format of any icons currently representing the respective items of peripheral equipment that are in an idling state, where the item of peripheral equipment is not in a state of processing a job, to be an image having the display format indicating the idling state, based on the operation information acquired by the operation information acquirer.

2. The item of information processing equipment according to claim 1, wherein when an item of peripheral equipment represented by the icon, whose designation has been detected by the designation detector, is in the state of processing a job, the display controller changes the display format of the icon representing the item of peripheral equipment which is already processing a job to be an image in the display format indicating processing of the job, in addition to the display format of the icon whose designation has been detected, and the display controller changes the display format of the icons representing each of the items of the peripheral equipment in the idling state to be an image in the display format indicating the idling state and displays, on the monitor screen, an indication to notify the operator of which items of peripheral equipment are available for prompt processing, based on the acquired operation information.

3. The item of information processing equipment according to claim 2, wherein when all of items of peripheral equipment including items of peripheral equipment represented by the icons, whose designation has been detected by the designation detector, are in the state of processing a job, the display controller changes the display format of each of the icons representing the items of peripheral equipment to be an image in the display format indicating the state of processing a job and displays, on the monitor screen, an indication to notify the operator that all items of peripheral equipment are in a state of job processing, based on the acquired operation information.

4. An image display program product for displaying an image, comprising:

an image display program which causes an item of information processing equipment connected to at least one item of peripheral equipment to function as:

a display controller for displaying, on a monitor screen, an icon representing each respective item of peripheral equipment;

a designation detector for detecting whether one of the icons displayed on the monitor screen by the display controller has been designated by an operator; and an operation information acquirer for acquiring, from each item of peripheral equipment, operation information indicating a job status of the respective item of peripheral equipment represented by each of the icons displayed on the monitor screen by the display controller, wherein the display controller judges whether the item of peripheral equipment represented by the icon is in the state of processing a job based on the operation information acquired by the operation information acquirer and then changes a display format of the icon on the monitor screen whose designation has been detected by the designation detector, to an image having a display format indicating a state of processing a job when the item of peripheral equipment represented by the icon, whose designation has been detected by the designation detector, is in the state of processing a job and displays, on the monitor screen, an indication indicating that the designated peripheral equipment is not available for prompt processing, and the display controller further changes a display format of any icons currently representing the respective items of peripheral equipment that are in an idling state, where the item of peripheral equipment is not in a state of processing a job, to be an image having the display format indicating the idling state, based on the operation information acquired by the operation information acquirer; and a signal bearing media bearing the image display program.

5. The image display program product according to claim 4, wherein the program further allows the information processing equipment to serve so that, when an item of peripheral equipment represented by the icon, whose designation has been detected by the designation detector, is in the state of processing a job, the display controller changes the display format of the icon representing the item of peripheral equipment which is already processing a job to be an image in the display format indicating processing of the job, in addition to the display format of the icon whose designation has been detected, and the display controller changes the display format of the icons representing each of the items of the peripheral equipment in the idling state to be an image in the display format indicating the idling state and displays, on the monitor screen, an indication to notify the operator of which items of peripheral equipment are available for prompt processing, based on the acquired operation information.

6. The image display program product according to claim 5, wherein the program further allows the information processing equipment to serve so that, when all of items of peripheral equipment including items of peripheral equipment represented by the icons, whose designation has been detected by the designation detector, are in the state of processing a job, the display controller changes the display format of each of the icons representing the items of peripheral equipment to be an image in the display format indicating the state of processing a job and displays, on the monitor screen, an indication to notify the operator that all items of peripheral equipment are in a state of job processing, based on the acquired operation information.

7. An image forming system comprising:

an item of information processing equipment; and at least one item of peripheral equipment connected to the item of information processing equipment, the item of information processing equipment including:

a display controller for displaying, on a monitor screen, an icon representing the respective item of peripheral equipment, a designation detector for detecting whether one of the icons displayed on the monitor screen by the display controller has been designated by an operator, and an operation information acquirer for acquiring, from each item of peripheral equipment, operation information indicating a job status of the respective item of peripheral equipment represented by each of the icons displayed on the monitor screen by the display controller, wherein the display controller judges whether the item of peripheral equipment represented by the icon is in the state of processing a job based on the operation information acquired by the operation information acquirer and then changes a display format of the icon on the monitor screen whose designation has been detected by the designation detector, to an image having a display format indicating a state of processing a job when the item of peripheral equipment represented by the icon, whose designation has been detected by the designation detector, is in the state of processing a job and displays, on the monitor screen, an indication indicating that the designated peripheral equipment is not available for prompt processing, and the display controller further changes a display format of any icons currently representing the respective items of peripheral equipment that are in an idling state, where the item of peripheral equipment is not in a state of processing a job, to be an image having the display format indicating the idling state, based on the operation information acquired by the operation information acquirer, the item of peripheral equipment including an operation information transmitter for sending, to the item of information processing equipment, the operation information of the item of peripheral equipment as to whether the item of peripheral equipment is in the state of processing a job, in response to a request from the item of information processing equipment as to whether the item of peripheral equipment is in the state of processing a job.

8. The image forming system according to claim 7, wherein when an item of peripheral equipment represented by the icon, whose designation has been detected by the designation detector, is in the state of processing a job, the display controller changes the display format of the icon representing the item of peripheral equipment which is already processing a job to be an image in the display format indicating processing of the job, in addition to the display format of the icon whose designation has been detected, and the display controller changes the display format of the icons representing each of the items of the peripheral equipment in the idling state to be an image in the display format indicating the idling state and displays, on the monitor screen, an indication to notify the operator of which items of peripheral equipment are available for prompt processing, based on the acquired operation information.

9. The image forming system according to claim 8, wherein when all of items of peripheral equipment including items of peripheral equipment represented by the icons, whose designation has been detected by the designation detector, are in the state of processing a job, the display controller changes the display format of each of the icons representing the items of peripheral equipment to be an image in the display format indicating the state of processing a job and displays, on the monitor screen, an indication to notify the operator that all items of peripheral equipment are in a state of job processing, based on the acquired operation information.

* * * * *